United States Patent [19]

Corey

[11] Patent Number: 4,958,496

[45] Date of Patent: Sep. 25, 1990

[54] MULTI-BOTTLE, NO COMPRESSOR, MEAN PRESSURE CONTROL SYSTEM FOR A STIRLING ENGINE

[75] Inventor: John A. Corey, Melrose, N.Y.

[73] Assignee: Mechanical Technology Incorporated, Latham, N.Y.

[21] Appl. No.: 460,826

[22] Filed: Jan. 4, 1990

[51] Int. Cl.[5] ..... F02G 1/04

[52] U.S. Cl. ..... 60/521

[58] Field of Search ..... 60/521

[56] References Cited

U.S. PATENT DOCUMENTS 3,782,119 1/1974 Gothberg ..... 60/521

*Primary Examiner*—Allen M. Ostrager

*Attorney, Agent, or Firm*—Joseph V. Claeys; Joseph C. Sullivan

[57] ABSTRACT

The invention relates to an apparatus for mean pressure control of a Stirling engine without the need for a compressor. The invention includes a multi-tank system in which there is at least one high pressure level tank and one low pressure level tank wherein gas flows through a maximum pressure and supply line from the engine to the high pressure tank when a first valve is opened until the maximum pressure of the engine drops below that of the high pressure tank opening an inlet regulator to permit gas flow from the engine to the low pressure tank. When gas flows toward the engine it flows through the minimum pressure supply line 2 when a second valve is opened from the low pressure tank until the tank reaches the engine's minimum pressure level at which time the outlet regulator opens permitting gas to be supplied from the high pressure tank to the engine. Check valves between the two tanks prevent any backflow of gas from occurring.

4 Claims, 1 Drawing Sheet

MULTI-BOTTLE, NO COMPRESSOR, MEAN PRESSURE CONTROL SYSTEM FOR A STIRLING ENGINE

Government of the United States of America has rights in this invention pursuant to Contract DEN3-32 awarded by the U.S. Department of Energy.

The present invention relates to a multi-bottle (or multi-tank), mean pressure control system for a Stirling engine. In particular, the present invention relates to a multi-tank, mean pressure control system for a Stirling engine that functions without a compressor.

BACKGROUND OF THE INVENTION

The Stirling or hot gas engine cycle is well known from in the art. A two-cylinder Stirling engine is described in U.S. Pat. Nos. 3,984,983 and 3,999,388 while a four cylinder engine is further described in U.S. Pat. Nos. 3,914,940 and 4,474,003. The Stirling engine is durable, clean burning, and exhibits relatively high efficiency when compared to the more conventional internal combustion engine. The Stirling engine, however, is relatively slow to respond to changes in power demands and thus difficult to adapt for use in motor vehicles where engine acceleration and deceleration must be rapid. Recently, efforts have been undertaken to improve the response time of the Stirling engine sot that it might be better suited for use in motor vehicles.

Power control of Stirling engines by variation of mean pressure is known to provide a very good part-load efficiency, and it does not require variable kinematics (as variable stroke and phase do). These qualities make mean pressure variation highly desirable for uses such as motive power where much of the operation is part-load and size and fast transient capability are very important. Unfortunately, with a fixed inventory of working gas available in engine and storage vessel, a pump is required to move gas at least one way (in or out) between engine and storage. In practice, this pump takes the form of a positive-displacement gas compressor of rapid response capability and often variable capacity. Such units are unavoidably expensive, bulky, and less reliable than required.

U.S. Pat. Nos. 4,601,171; 4,601,172; 4,612,769; and 4,655,036 (all assigned to the assignee of the present application) disclose different aspects of a control scheme where 2 or more storage bottles (tanks) are maintained at different pressures so that the pressure ratio across the compressor is minimized. Thus each of these patents describes a control system utilizing a compressor.

FIG. 2 shows a known one tank, non-compressor system. Such a system can modulate pressure and power over a limited range depending on engine pressure and tank capacity. In such a one tank system, however, when tank volume is infinite or pressure is otherwise held constant at $P_1$, then the minimum available power a large fraction of maximum power. The situation is worse if flow into and out of a finite volume tank affects its pressure level.

SUMMARY OF THE INVENTION

Hence with the foregoing in mind, it is a principal object of the invention to provide a mean power control system for a Stirling engine that avoids the drawbacks associated with the aforementioned prior art arrangements.

It is yet another object to provide a mean pressure control system for a Stirling engine that does not require a compressor.

It is still another object of the invention to provide a mean pressure control system for the Stirling engine that does not utilize a compressor nor employ a complex control valve scheme.

In order to implement these and other objects of the invention, which will become more readily apparent as the description proceeds, the present invention provides for at least one high pressure tank, at least one low pressure tank, a maximum pressure supply line to permit gas flow from the Stirling engine to the tanks when a first valve is opened, a minimum pressure supply line for permitting a flow of gas from the tanks to the Stirling engine when a second valve is opened, an outlet regulator for the high pressure tank adapted to open when the pressure in the high pressure tank is higher than that of the Stirling engine and an inlet regulator for the low pressure tank adapted to open when the pressure level on the Stirling engine has maximum pressure level lower than that of the high pressure tank.

BRIEF DESCRIPTION OF THE DRAWINGS

For a fuller understanding of the nature and objects of the invention, reference should be had to the following detailed description, taken in connection with the accompanying drawings, in which.

DETAILED DESCRIPTION OF THE PREFERRED EMBODIMENTS

Figure 1:
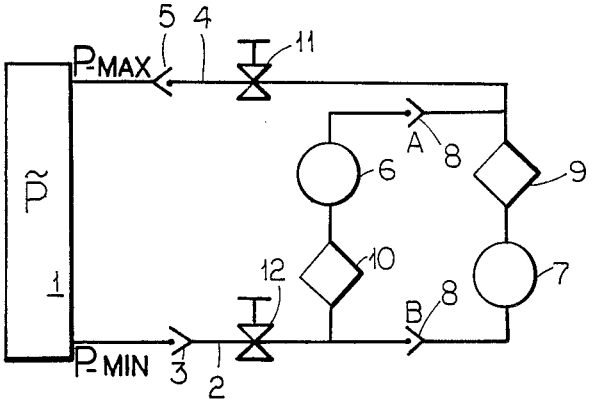
FIG. 1 is a schematic of an embodiment of the invention employing a two tank system.

Referring now to the drawings, FIG. 1 illustrates an embodiment of the present invention in which a Stirling engine 1 is connected to a nested tank arrangement. In this simplest embodiment, the invention includes the Stirling engine 1, a minimum pressure supply line 2 isolated from the engine by a check valve 3, a maximum pressure supply line 4 isolated from the engine by a second check valve 5, a high pressure tank 6, a low pressure tank 7, two additional check valves 8A and 8B, between the tanks 6 and 7, an inlet regulator 9 on the low pressure tank 7, and an outlet regulator 10 on the high pressure tank 6. FIG. 1 further discloses actuator valves 11 and 12.

In operation, inlet regulator 9 will open only when the maximum pressure ($P_{max}$) of the Stirling engine 1 is less than the pressure of the high pressure tank 6. When inlet regulator 9 is closed, the engine dump gas, gas transferred from the engine 1 to one of the tanks 6, 7 is forced to enter the high pressure tank 6. Outlet regulator 10 is set to open when the minimum pressure ($P_{min}$) of the engine 1 exceeds the pressure of the low pressure tank. When the outlet regulator 10 is closed, then engine supply gas (gas transferred from one of the tanks 6, 7 to the Stirling engine 1) must be supplied from the low pressure tank 7 first, just as regulator 9 forced the gas to be pumped to the high pressure tank 6 first.

The invention, as shown in FIG. 1, operates as follows: to achieve a down power transient, requiring transfer of gas from engine to tanks, valve 11 is opened so that gas flows from the engine to the high pressure tank 6 until the engine's maximum pressure level, $P_{max}$, drops to near that of the high pressure tank. Under these conditions gas flow is precluded to the high pressure tank 6 due to the lack of pressure difference between the high pressure gas tank and the engine. At that point, inlet regulator 9 opens and gas now flows from the engine 1 to the low pressure tank 7. This gas flow will continue until the engine $P_{max}$ reaches the pressure level of the low pressure tank 7. Check valve 8A prevents any backflow from the high pressure tank 6 to the low pressure tank 7. When the engine 1 has reached its desired pressure and power level the valve 11 closes.

An up-power transient, gas flow from tank to engine, is similarly achieved through supply line 2. Valve 12 is opened and supply gas flows from the low pressure tank 7 until the low pressure tank reaches its $P_{min}$ (minimum pressure) level. Outlet regulator 10 opens at this point and gas is supplied to the engine 1 from the high pressure tank 6. Check valve 8B prevents backflow from the high pressure tank 6 to the low pressure tank 7.

Figure 2:
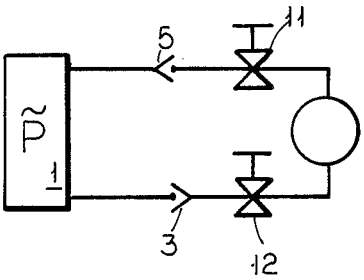
FIG. 2 PRIOR ART
FIG. 2 is a prior art system utilizing a single tank.

FIG. 2 shows a known prior art self pumping system which employs a single tank. However, such prior art one tank systems can modulate pressure (and thereby power) over only a limited range which depends on engine pressure ratio and tank capacity In such a prior art system, for example, when $P_{max}=1.25\ P_{mean}$, and $P_{min}=.75\ P_{mean}$ for a typical engine, for an infinite tank volume or where pressure is otherwise held constant at $P_1$, then the highest possible minimum pressure $P_{min}=P_1$ (end of supply delta p) for a $P_{mean}$ minimum of (1/1.25) $P_1$ (end of supply delta p) or a $P_{mean}$ maximum of (1/.75) $P_1$ . The lowest possible $P_{max}=P_1$ (end of dump delta p) for a $P_{mean}$ minimum of (1/1.25) $P_1$. Since power is roughly proportional to $P_{mean}$, this means that the maximum available power modulation is from highest power at 1/.75 $P_1$ to lowest power at 1/1.25 $P_1$, a ratio of 1.25/.75 or 5/3 (1.67). Thus, the minimum available power is 60% of maximum power. This turndown limit is worse if flow into and out if a finite volume tank affects its pressure level.

Accordingly, in the two tank embodiment of the present invention of FIG. 1, the second tank acts on the residual 60% power level to bring down that down to its own 60% minimum or 36% of the original maximum power. Further, the concept is applicable, to any number of tanks to achieve further reductions of minimum power where:

3 tanks→21.6%=minimum power 4 tanks→13%=minimum power 5 tanks→8%=minimum power

Figure 3:
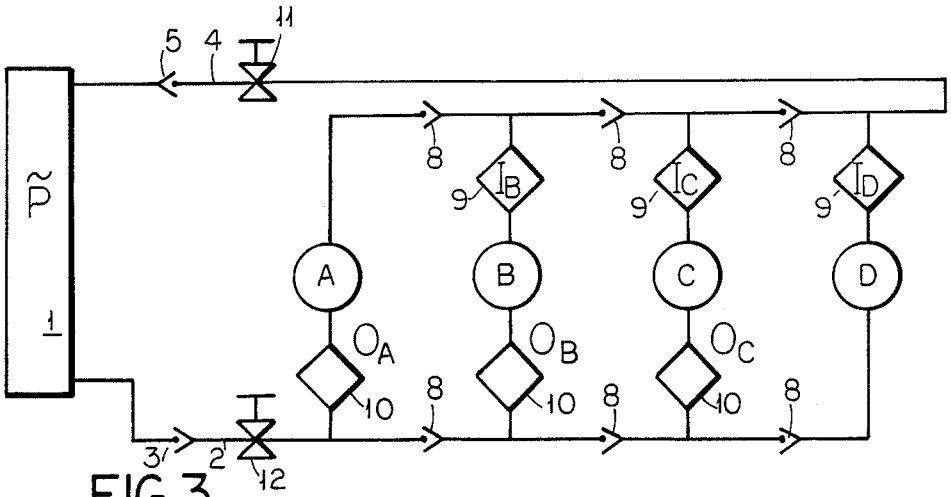
FIG. 3 is another embodiment of the invention in which a four tank system is employed.

FIG. 3 discloses a four tank embodiment of the present invention in accordance with the aforementioned principles which operates similarly to FIG. 1 and the symbols correspond to those in FIG. 1. In FIG. 3 the reference letter A designates the highest pressure tank, through B & C to D, with D being the lowest pressure tank. Regulator settings are as follows:

IB open when $P_{max}<A$,
IC open when $P_{max}<B$,
ID open when $P_{max}<C$,
OA open when $P_{min}>B$,
OB open when $P_{min}>C$,
OC open when $P_{min}>D$.

Accordingly the present invention is not limited to any number of tanks, as any number of tanks nested and correspondingly arranged in accordance with the fashion described herein can be employed so that for n tanks the minimum power obtained is 60% to the power of n.

Obviously, numerous modifications may be made without departing from its scope as defined in the appended claims.

What is claimed is:

1. A mean pressure control system for a Stirling engine, comprising:

at least one high pressure tank;

at least one low pressure tank;

said high pressure tank and said low pressure tank each including a check valve to prevent backflow of gas from one tank to the other during operation;

at least one inlet regulator for each said low pressure tank adapted to open when said engine has a maximum pressure level lower than that of the next higher pressure tank;

at least one outlet regulator for each said high pressure tank adapted to open when next lower pressure tank has a minimum pressure level higher than that of said engine;

a maximum pressure supply line including a first valve connecting said engine to said high pressure tank and to said inlet regulator;

a minimum pressure supply line including a second valve connecting said engine to said low pressure tank valve and to said outlet regulator so that when said first valve is open gas is transferred through said maximum pressure supply line from said engine to said high pressure tank until said engine pressure level drops below that of said high pressure tank thereby opening said inlet regulators so that gas is then transferred from said engine to said low pressure tank; and wherein said second valve is opened gas is supplied through said minimum pressure supply line from said low pressure tank to said engine until said engine pressure level is above that of said low pressure tank thereby opening said outlet regulator so that gas is transferred through said minimum pressure supply line from said high pressure tank to said engine.

2. A mean pressure control system according to claim 1, wherein there is one high pressure tank and one low pressure tank.

3. A mean pressure control system according to claim 2, further comprising check valves between said high pressure tank and low pressure tank to prevent any backflow of gas.

4. A mean pressure control system according to claim 1, wherein there is one high pressure tank and three low pressure tanks each having different pressure levels; said high pressure tank and said low pressure tanks being arranged in nested order in order of descending high pressure levels with highest pressure level tanks closest to said engine.

* * * * *